US006109878A

United States Patent [19]

Barton et al.

[11] Patent Number: 6,109,878

[45] Date of Patent: Aug. 29, 2000

[54] SYSTEM AND A METHOD FOR VELOCITY MODULATION FOR PULSELESS OPERATION OF A PUMP

[75] Inventors: Jeffrey Glenn Barton; Steven Soar, both of Vancouver, Wash.

[73] Assignee: Micropump, Inc., Vancouver, Wash.

[21] Appl. No.: 09/059,941

[22] Filed: Apr. 13, 1998

[51] Int. Cl.[7] ..... F04B 49/00

[52] U.S. Cl. ..... 417/14; 417/12; 417/42; 417/326

[58] Field of Search ..... 417/14, 12, 42, 417/326

[56] References Cited

U.S. PATENT DOCUMENTS

| | | | |
|---|---|---|---|
| Re. 31,586 | 5/1984 | Magnussen, Jr. | 417/22 |
| 646,024 | 3/1900 | Goodhart | 91/499 |
| 2,225,788 | 12/1940 | McIntyre | 103/173 |
| 2,397,594 | 4/1946 | Buchanan | 103/173 |
| 2,745,350 | 5/1956 | Capsek | 103/41 |
| 3,272,079 | 9/1966 | Bent | 91/175 |
| 3,823,557 | 7/1974 | Van Wagenen et al. | 60/325 |
| 4,352,636 | 10/1982 | Patterson et al. | 417/22 |
| 4,432,310 | 2/1984 | Waller | 123/58 |
| 4,797,834 | 1/1989 | Honganen et al. | 364/510 |

FOREIGN PATENT DOCUMENTS

| | | |
|---|---|---|
| 566 020 | 7/1975 | Russian Federation . |
| 768330 | 4/1954 | United Kingdom . |

*Primary Examiner*—Timothy S. Thorpe
*Assistant Examiner*—Timothy P Solak
*Attorney, Agent, or Firm*—Hill & Simpson

[57] ABSTRACT

A system and a method are provided for velocity modulation to create pulseless delivery of a fluid by a pump, particularly a piston pump. The system and method require input of data, such as a user-entered dispense rate or analog current or voltage input proportional to a desired output rate. A timer or counter is pre-loaded from a lookup table stored in a processor. The time or counter is started and, upon detection of an overflow condition, the motor and table pointer are incremented one step. As a result, pulseless operation of a pump is achieved.

15 Claims, 1 Drawing Sheet

SYSTEM AND A METHOD FOR VELOCITY MODULATION FOR PULSELESS OPERATION OF A PUMP

The present invention generally relates to a reciprocating pump that provides substantially pulseless delivery of a liquid. The pump is particularly suited for supplying liquids used in chromatographic analysis devices where pulseless flow at low flow rates is required to achieve high instrument sensitivity. More specifically, the present invention relates to reducing pressure pulsation of a pump. To this end, a drive motor is speeded up or slowed down based on where the pump is in the pumping cycle. As a result, a pulseless output is achieved.

Constant volume, pulseless reciprocating pumps are generally known and disclosed in U.S. Pat. Nos. 3,861,029; 4,028,018; 4,687,426; and 4,556,371. A piston pump using a spool valve to control liquid outlet from the pistons is similarly shown in European Patent No. A20 172 780.

Pulseless delivery of a liquid is described in detail in U.S. Pat. No. 4,359,312 which discloses a reciprocating piston pump with two pistons connected in parallel on the discharge side. One of the pistons draws in fluid while the other is delivering fluid. The pistons are controlled by a cam which is, in turn, operated by a computer program to compensate for the compressibility of liquid in the pump. The rotational speed of the cam is varied to compensate for the compressibility of liquid in the pump and to achieve a constant pump output.

U.S. Pat. No. 2,020,377 describes a dual piston pump that achieves non-pulsating fluid output by overlapping the power strokes of each piston in the pump, and controlling the volumetric displacement of the pump per cycle. The combined delivery of the two pistons, per unit time, is substantially constant or non-fluctuating.

Each of the pumps in the patents described above is relatively large and not well adapted for pumping and delivering very small amounts of liquid which is required for supplying analyzer devices. The prior pumps are particularly unsuitable for placement in a compact pumping assembly. Some of these previous pumps also suffer from the disadvantage of requiring complicated computer programs and automated control mechanisms to achieve constant pump output. Further, known piston pumps often have a severe pressure pulsation.

A need, therefore, exists for an improved system and method for pulseless operation of a piston pump by velocity modulation.

SUMMARY OF THE INVENTION

The present invention relates to a method for modulating velocity to create pulseless operation of a pump. To this end, in an embodiment of the present invention, the method comprises the steps of: providing an input to determine rate of dispense; providing a look-up table to determine how much time before incrementing to the next dispense step; loading a timer based on data from the look-up table; and upon timer/counter overflow, driving a stepper motor one step upon overflow of the timer/counter.

In an embodiment, during steps where a low flow is expected from the pump, the motor is stepped faster; during steps where higher flow is expected, the motor is stepped slower.

In addition, a sensor detects a magnet mounted to a cam mounted to the motor shaft. The sensor gives a signal once per revolution (400 steps per revolution) to signal to the microprocessor where the pump is in its dispense cycle. The sensor is not required, but it is useful for detecting fault conditions and synchronizing the microprocessor look-up table to the pump dispense cycle.

Accordingly, in one embodiment of the present invention, direct user entry of a desired dispense rate is allowed using buttons and a liquid crystal display. The user enters the desired dispense rate and starts the pump. The microprocessor calculates a look-up table of delayed times based on a trigonometric formula and the entered desired dispense rate. The user then must start and stop the pump. However, the pump may be started and stopped by some other means, such as, for example, a timer or the like. The microprocessor pre-loads a timer with a value from the calculated look-up table. When the microprocessor timer overflows, the microprocessor drives the stepper motor forward one step. The next value in the look-up table is then pre-loaded into the timer.

The above-described embodiment, therefore, provides a system and a method that allows direct human interface, more accurate dispense rate, and a relatively complex and flexible microprocessor-based system.

In another embodiment of the present invention, external control signals are used to generate a square wave which is fed into the microprocessor. Either a 4–20 milliamp signal or a 0–5 volt signal is fed into a voltage controlled oscillator (VCO). The output of the VCO or, alternatively, an externally generated square voltage is then fed into the microprocessor. The frequency of the square wave is proportional to the pump dispense rate. The microprocessor pre-loads a counter with a value from a permanent, unchanging look-up table. The counter counts the number of square wave cycles until the counter overflows. After the counter overflows, the microprocessor drives the stepper motor forward one step. The next value in the look-up table is then pre-loaded into the counter. No specific time in which the counter overflows exists unlike the first embodiment which uses a timer.

Accordingly, this embodiment of the present invention advantageously uses a counter that allows the look-up table to be permanent. Since there is no tie to specific times, the dispense rate can be varied without stopping the pump. The analog nature of the system allows standard industrial control signals to be fed to the controller. The control method implements a very simple and inexpensive microcontroller.

In an embodiment, the input is an analog current input proportional to a desired output dispense rate.

In an embodiment, the input is an analog voltage input proportional to a desired output dispense rate.

In an embodiment, the look-up table is filled with an internal array of numbers based on the input data.

In an embodiment, the look-up table includes numbers that set an amount of time between state changes of a frequency output.

In an embodiment, the motor is driven one step per state change.

In an embodiment, the desired rate changes during operation of the pump.

In an embodiment, the table pointer is incremented one step based on a detected change in the output state.

In another embodiment of the present invention, a system is provided for modulating velocity to create pulseless operation of a pump driven by a motor. The system comprises an input device to enter an input associate with a desire rate for dispensing of a liquid. A processor has a look-up table stored therein that is capable of detecting changes in state of the output. A timer is loaded with data from the look-up table. Driving means is provided to drive the motor based on the detected changes in the state of the output.

In an embodiment, the driving means steps the motor one step per state change.

In an embodiment, the input is a user-entered dispense rate.

In an embodiment, the input device is a user interface.

In an embodiment, the look-up table of the processor is filled with an internal array of numbers based on the input.

In an embodiment, each of the numbers of the internal array sets the amount of time between output state changes.

It is, therefore, an advantage of the present invention to provide a system and a method to modulate velocity thereby creating pulseless operation of a pump.

Another advantage of the present invention is to provide a system and a method that reduces computational overhead in the processor.

Yet another advantage of the present invention is to provide a system and a method that enables a user to change dispense rates during revolution or a motor shaft driving a pump.

A still further advantage of the present invention is to provide a system and a method for pulseless operation using existing customer hardware without modification thereof.

Moreover, an advantage of the present invention is to provide a system and a method for pulseless operation that offers a human interface.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a system and a method for pulseless operation of a piston pump. More specifically, the present invention relates to a system and method for velocity modulation for pulseless operation of a piston pump.

A piston pump is generally described in commonly assigned U.S. Pat. No. 5,733,105, the subject matter of which is incorporated herein by reference in its entirety. Although various embodiments of piston pumps are described therein, it should be understood that various other pumps may implement the system and method of the present invention to create pulseless operation via velocity modulation as described by the system and method of the present invention.

Figure 1:
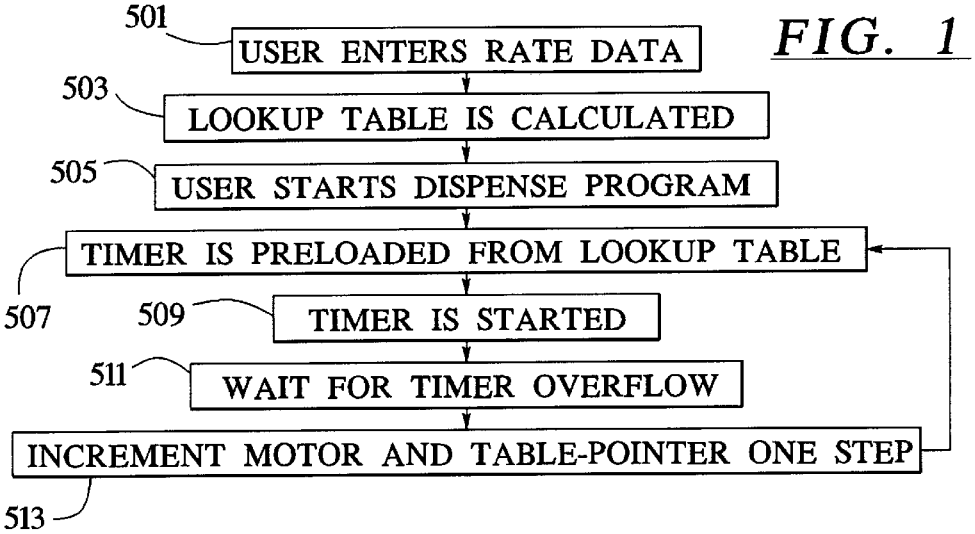
FIG. 1 illustrates a flowchart of an embodiment of a method to implement pulseless operation of a pump.
Figure 2:
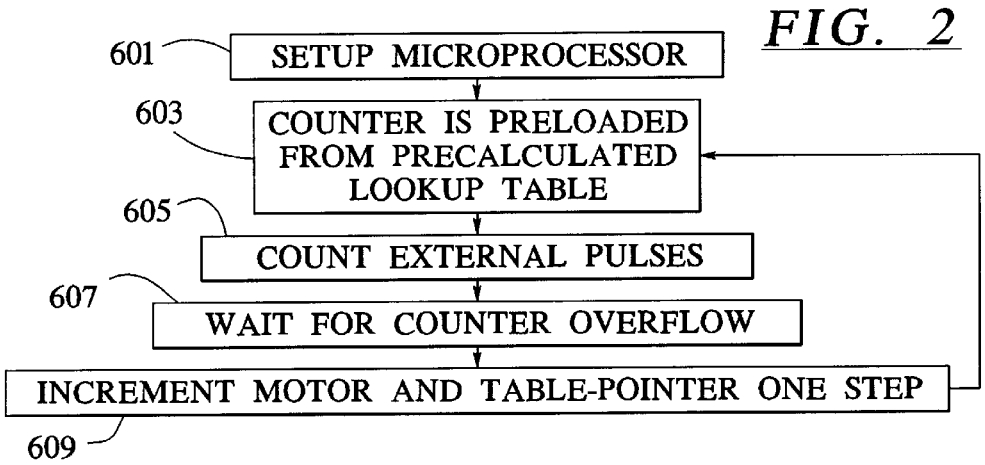
FIG. 2 illustrates a flowchart of another embodiment of a method to implement pulseless operations of a pump.

The system and method of the present invention will now be explained hereinafter with reference to FIGS. 1–3. Referring now to FIGS. 1 and 2, two flowcharts are shown to implement velocity modulation and create pulseless operation of any type of the piston pump. Of course, the method and system described may be applied to many other pumps and pumping devices as well, and the present invention is not to be construed as limited to a specific type of pump.

FIG. 1 represents a first embodiment and method using velocity modulation for pulseless operation of a piston pump. FIGS. 1 and 2 should be understood in conjunction with a system 500 illustrated in FIG. 3. As shown in FIG. 3, a user interface 502 is provided for entering data into the system 500, such as, for example, dispense rate for the piston pump. The information that is entered at the user interface board 502 is sent to a microprocessor 504 which controls the operation of a stepper motor 506 operatively connected to a pump 512 for driving the same.

After the dispense rate is entered by a user at the user interface 502, the microprocessor 504 fills an internal array of numbers based on the input data. Each number in the array establishes an amount of time between state changes of a frequency output pin. As a result, a time-modulated square wave signal is generated and fed to the stepper motor driver 508. The stepper motor driver 508 steps the motor 506 one step per state change. The resulting angular velocity of the stepper motor 506 is, therefore, approximately the inverse of a rectified sine wave. The angular velocity waveform is the inverse of the waveform of the pump's instantaneous dispense rate vs. motor angle. A key to the present invention is to drive the motor faster when the pump is dispensing less fluid and to drive the motor slower when the pump is dispensing more fluid. Further, resultant pressure and flow are nearly constant. A pressure dip only exists when the sine function is approximately zero since the inverse of zero is infinity. In this state, the stepper motor 506 cannot move at a fast enough pace.

As shown in FIG. 1, at step 501, a user enters rate data as previously set forth with reference to the system 500 in FIG. 3 using the user interface 502. A look-up table is calculated and stored by the microprocessor 504 at step 503. After calculation, the dispense operation may begin as shown at step 505. At that point, as shown by step 507, a timer 514 is pre-loaded from the look-up table, and the timer 514 may then be started (step 509). The microprocessor 504 detects a point at which the timer 514 overflows as shown at step 511. Then, at step 513, the motor 506 and table pointer of the look-up table are incremented one step and the timer is again pre-loaded from the look-up table as illustrated at 507 and the process continues or repeats.

FIG. 2 illustrates a method of an alternate embodiment for pulseless operation of a pump, such as a piston pump, via velocity modulation. For control, the user may select one of three options: an analog current input proportional to desired output rate; an analog voltage proportional to desired output rate; or a square wave with frequency proportional to a desired output rate. If an analog current input is selected, the current signal is fed through a current-to-voltage converter (not shown). Then, the input voltage signal or the converted current signal is fed into a voltage controlled oscillator. At that point, the converted analog or input frequency signals are input into the microprocessor 504.

Figure 3:
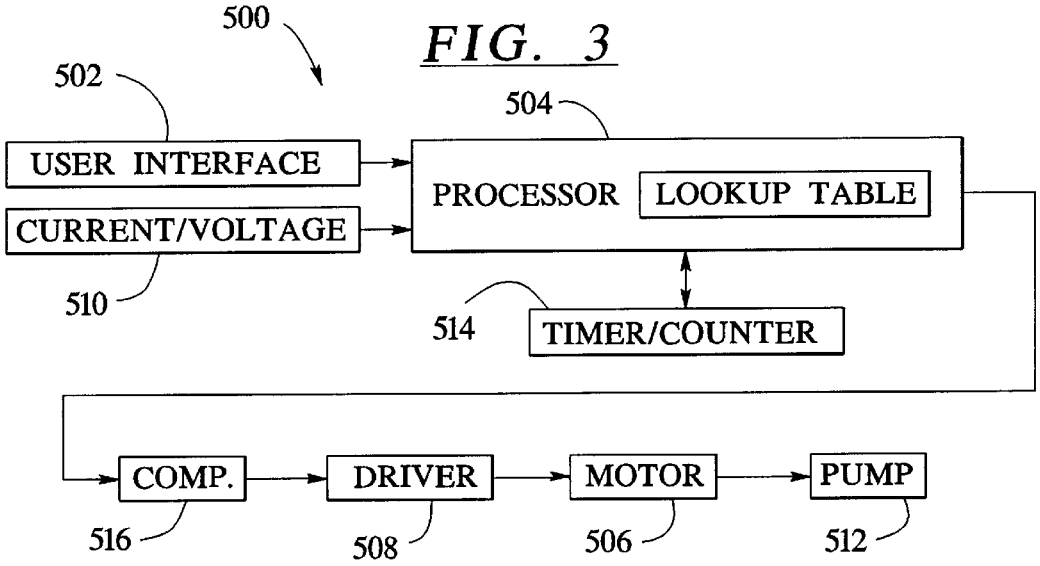
FIG. 3 illustrates a black box diagram of an embodiment of a system to implement pulseless modulation of a system.

Element 510 generically illustrates this input in FIG. 3. As shown in FIG. 2, the microprocessor 504 is set up as shown at step 601, and a counter 514 is pre-loaded from a pre-calculated look-up table at step 603. The value pre-loaded from the look-up table determines how many input pulses are counted between motor steps. At that point, input pulses are counted at step 605 by the microprocessor 504. At the point at which counter overflow is detected as shown at step 607 in FIG. 2, the stepper motor 506 is stepped forward one step, and the table pointer is incremented one step as shown at step 609. The method then returns to step 603 wherein the counter 514 is pre-loaded from the pre-calculated look-up table. As a result of the method shown and described with reference to FIGS. 1 and 2, pulseless dispenses at an accurate, continuous rate are produced.

The method shown and described with reference to FIG. 2 provides less computational overhead in the microprocessor, and the user is able to change dispense rates in mid-revolution of the motor shaft. In addition, the pump is automatically controlled with standard industrial control signals without further modification. The method shown and described with reference to FIG. 1 advantageously offers a human interface as well as the potential for RS-232 communication with a host computer. The method also offers a more precise dispense rate control than the other embodiment.

The present invention, therefore, provides precalculation of the flow per unit of change in piston position per step using, for example, a step motor. This may be performed with a constant attack angle on the cams, or alternatively, with a varied de-attack angle on the cams. In either case, the desired end result is to create constant piston movement per unit of time. Thus, a constant volume of fluid is dispensed per unit of time. The attack angle of the cam may be any desired attack angle, the number of pistons may be different than two, and other portions of the pump design may, as well, be variable. One of the keys of the present invention is, therefore, the precalculation of the volumes of fluid dispensed by the pump for each step of rotation of the motor. This concept may also be implemented to a broader range of pumps than described by the present invention.

In view of the foregoing, the look up table of the present invention may vary for each pump design, for each attack angle and/or for the number of pistons per pump. Nonetheless, the concepts presented and taught by the present invention are applicable to all such variations since each is calculatable once the decision is made as to the geometry of the various components of the pump. As a result of the foregoing, the motor speed is varied to provide constant flow from the pump.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A method for modulating drive velocity to create pulseless operation of a pump, the method comprising the steps of:

a. providing an input associated with a desired rate of dispensing of a liquid by the pump;

b. providing a look-up table containing a plurality of steps and time increments for each step based upon the desired rate of dispensing;

c. loading a timer for carrying out one of said plurality of steps based on data from the look-up table;

d. starting the timer;

e. waiting for a timer overflow; and f. incrementing the look-up table one step and driving the motor one step and repeating steps b through d thereby creating substantially constant pressure and flow of liquid from the pump.

2. The method of claim 1 wherein the input is a dispense rate entered by a user.

3. The method of claim 1 wherein the input is an analog current input proportional to the desired rate of dispensing.

4. The method of claim 1 wherein the input is an analog voltage proportional to the desired rate of dispensing.

5. The method of claim 1 wherein the look-up table is filled with an internal array of numbers based on the input data.

6. The method of claim 1 further comprising the step of:

changing the desired rate during operation of the pump.

7. A system for modulating drive velocity to create pulseless operation of a pump driven by a motor, the system comprising:

an input device to enter an input associated with a desired rate for dispensing of a liquid;

a processor having a variable look-up table stored therein and capable of changing the look-up table, the look-up table containing a plurality of steps and time increments for each step based upon the desired rate of dispensing;

a timer in communication with the processor and capable of being loaded with data from the look-up table and further being capable of sending a signal to the microprocessor when the timer overflows; and driving means to drive the motor based on overflow of the timer.

8. The system of claim 7 wherein the input is a user-entered dispense rate.

9. The system of claim 7 wherein the input is an analog current input proportional to the desired rate.

10. The system of claim 7 wherein the input is an analog voltage proportional to the desired rate of dispensing.

11. The system of claim 7 wherein the input device is a user interface.

12. The system of claim 7 wherein the look-up table of the processor is filled with an internal array of numbers based on the input.

13. A method for modulating drive velocity to create pulseless operation of a pump, the method comprising the steps of:

providing an input associated with a desired rate of dispensing of a liquid by the pump;

providing a fixed look-up table containing a plurality of steps and cycles for each step;

loading a counter for carrying out one of said plurality of steps;

starting the counter;

waiting for a counter overflow; and incrementing the look-up table one step and driving the motor one step and repeating the loading step thereby creating substantially constant pressure and flow of liquid from the pump.

14. The method of claim 13 wherein the input is a square wave whose frequency is proportional to the desired rate of dispensing.

15. A system for modulating drive velocity to create pulseless operation of a pump driven by a motor, the system comprising:

an input device to enter an input associated with a desired rate for dispensing of a liquid;

a processor having a fixed look-up table stored therein, the look-up table containing a plurality of steps and a number of cycles for each step based upon the desired rate of dispensing;

a counter in communication with the processor and capable of being loaded with data from the look-up table and further being capable of sending a signal to the microprocessor when the counter overflows; and driving means to drive the motor based on overflow of the counter.

* * * * *